US005284200A

United States Patent [19]

Gegel

[11] Patent Number: 5,284,200

[45] Date of Patent: Feb. 8, 1994

[54] METHOD OF FORMING A BONDED COMPONENT

[75] Inventor: Gerald A. Gegel, Morton, Ill.

[73] Assignee: Caterpillar Inc., Peoria, Ill.

[21] Appl. No.: 970,453

[22] Filed: Nov. 2, 1992

[51] Int. Cl.[5] ..... B22D 19/14

[52] U.S. Cl. ..... 164/98; 164/69.1; 164/100

[58] Field of Search ..... 164/98, 69.1, 97, 100, 164/99, 120, 119, 113

[56] References Cited

U.S. PATENT DOCUMENTS

| | | | |
|---|---|---|---|
| 3,949,804 | 4/1976 | Kaneko | 164/69.1 |
| 4,067,379 | 1/1978 | Hassler | 164/69.1 |
| 4,216,682 | 8/1980 | Ban et al. | 74/579 |
| 4,909,300 | 3/1990 | Horie | 164/69.1 |
| 5,004,036 | 4/1991 | Becker | 164/97 |

FOREIGN PATENT DOCUMENTS

| | | | |
|---|---|---|---|
| 0340957 | 8/1989 | European Pat. Off. | 164/100 |

OTHER PUBLICATIONS

Pressure Infiltration Casting of MMC's, Mat'ls Science and Engineer, AI44, Sep. 1991.

*Primary Examiner*—Kurt C. Rowan
*Assistant Examiner*—Rex E. Pelto
*Attorney, Agent, or Firm*—Robert A. McFall

[57] ABSTRACT

The present invention relates to a method for bonding metal and ceramic parts to form a bonded component. The method of the present invention allows the metal part and the bond to be fabricated concurrently. The strength of the bond can be controlled through choice of the material for the metal part, and by varying the thickness of the bond region. The bond region is formed by mixing ceramic particles with fibers and subsequently removing the fibers forming voids within the ceramic part. The bond region is formed with a second ceramic particle region adjacent to it.

7 Claims, 1 Drawing Sheet

METHOD OF FORMING A BONDED COMPONENT

FIELD OF THE INVENTION

The present invention relates to a method for bonding metal and ceramic parts. More particularly, the method of the present invention allows the metal part and the bond to be fabricated concurrently.

BACKGROUND OF THE INVENTION

Ceramics are inorganic solids which are characterized by hardness, brittleness (non-ductility), and heat resistance (refractoriness). Ceramic objects are manufactured by subjecting powdered starting materials to a high temperature and pressure processing stage. Ceramics can operate at temperatures above those at which metals lose significant residual strength, while retaining useful attributes including resistance to abrasive wear and to many chemical environments. However, ceramics do not exhibit strength under tension and often act in a brittle or non-ductile manner. The brittleness is usually caused by crevices and faults on the surface or within the material, from which the fracture process commences on applying a stress. Therefore, it is desirable to join or bond a ceramic component functioning at high temperature to structures or moving parts which must withstand stresses too great for ceramics and must consequently be metals.

A ceramic-metal bond can be achieved through mechanical joining, such as with metal hooks or dog bones, or through press and shrink fitting. Alternatively, a metal coating can be placed on the ceramic part through plasma spraying. However, there is a limit to the thickness of the material that can be applied in this manner. Another technique which has been used to bond a metal and a ceramic is brazing. This technique can be more expensive as it requires a brazing metallization layer such as molybdenum or molybdenum-manganese. Additionally, the strength of the bond cannot easily be varied or controlled, and the bonding process is an additional step in the fabrication of the bonded component.

Accordingly, prior to the development of the present invention, there has been no method of bonding a ceramic part to a metal part so that the bond strength can be controlled, and so that the metal part and the bond can be formed concurrently. Therefore, it is an object of the present invention to provide a method of bonding a ceramic part and a metal part so that the bond strength can be controlled. It is a further object of the present invention to provide a method of bonding a ceramic part and a metal part so that the fabrication of the metal part and of the bond can be done concurrently. It is a feature of the method of the present invention that the bond strength can be controlled through choice of the material for the metal part, and by varying the effective surface area of the bond interface region.

SUMMARY OF THE INVENTION

The present invention relates to a method for bonding metal and ceramic parts to form a bonded component. One method of forming a bonded component begins with fabricating a ceramic part so that it includes a region of interconnected channels or porous voids. The ceramic part is then heated and placed in a pressure or squeeze casting die. Molten metal is then added to the die, and the die is pressurized to cast the metal part and to force the molten metal into the interconnected channels or porous voids. The bond is formed when the molten metal in the interconnected channels or porous voids solidifies. The metal part and the bond are thus formed concurrently. The bonded component is then ejected from the die.

One method of fabricating a ceramic part with interconnected channels or porous voids begins with addition of fibers to a ceramic powder to form a ceramic mixture. The ceramic mixture is then compacted and fired. During the firing step, the fibers are burned away, leaving a plurality of interconnected channels or porous voids. Another method of forming a ceramic part with interconnected channels or porous voids also begins with the addition of fibers to a ceramic powder to form a ceramic mixture. The ceramic mixture is then cast into a ceramic shape to which chemical agents are added to dissolve the fibers.

Another method of forming a bonded component also begins with fabricating a ceramic part so that it includes a region of porous voids. The ceramic part is then placed in a pressure or squeeze casting die. A metal matrix alloy is then injected into the die, forcing the metal matrix alloy into the porous voids of the metal matrix component. The bond is formed when the metal matrix alloy in the porous voids solidifies. The metal matrix part and the bond are thus formed concurrently.

The bonded component formed through the methods of the present invention includes a ceramic part, a metal part, and a bond part which joins the netal and ceramic parts. The bond part includes interconnecting channels which are filled with the same metal used for the metal part of the bonded component.

BRIEF DESCRIPITON OF THE DRAWINGS

Various objects, features, and advantages of the present invention will be more fully appreciated as the same becomes better understood from the following detailed description of the present invention when considered in connection with the accompanying drawings, in which:

FIG. 1 shows a cross-section of a bonded component formed by the method of the present invention; and FIG. 2 shows an enlarged cross-section of the bond region of the component shown in FIG. 1.

DETAILED DESCRIPTION OF THE INVENTION

Figure 1:
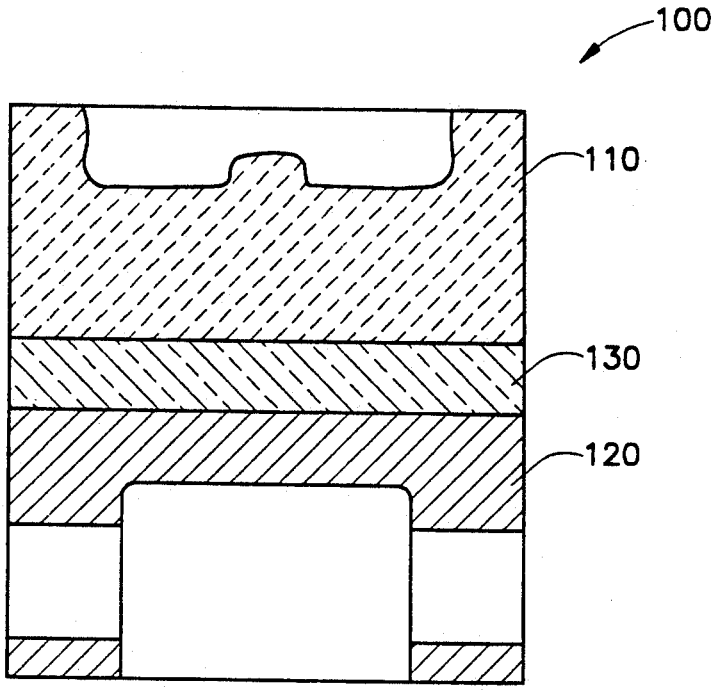

With continuing reference to the drawing figures in which similar reference numerals are used throughout the description to describe similar features of the invention, FIG. 1 shows a cross-section of a bonded component 100 formed by the method of the present invention. The bonded component is comprised of a ceramic part 110 and a metal part 120. The ceramic part and the metal part are joined at the bond region 130.

The ceramic part 110 can be made from known ceramics, such as alumina, and is preferably fully dense or non-porous, as compared to the bond region 130 discussed below. The shape of the ceramic part will be determined by the shape required for the overall bonded component. For example, the overall bonded component may be an engine piston or valve. The ceramic part could take the shape of the valve or piston as it has high temperature strength, and the metal part could form a base or substrate for structural support.

The metal part 120 can be made from known metals, such as aluminum, magnesium, or alloys of aluminum or magnesium. Alternatively, a metal matrix composite such as an aluminum or magnesium alloy containing micron-sized silicon carbide particulates ($Al/SiC_p$ or $Mg/SiC_p$) can be used. As discussed above, the shape of the metal part will also be determined by the shape and function of the overall bonded component. For an engine valve or piston, the metal part provides a structural base for the ceramic part as the ceramic is brittle or non-ductile.

The ceramic part and the metal part are joined at the bond region 130. As compared to the ceramic part 110 which is fully dense, the bond region contains a plurality of interconnected channels or interconnecting porous voids, thus forming a bond interface region with a large effective surface area. These channels are then filled with the same metal as the metal part to form the bond or joint. The mechanical strength of the joint is a function of the cross-sectional area of the metal cast into the interconnected channels or porous voids, and of the tensile strength of the metal. The cross-sectional area of the metal cast into the interconnected channels or porous voids will be determined by the density of the ceramic in the bond region (number of channels or voids per unit area), as well as the thickness of the bond region 130. As shown in FIG. 1, the thickness of the bond region 130 can be varied, with a corresponding increase or decrease in the thickness of the ceramic part 110. As the thickness of the bond region 130 increase, the thickness of the ceramic part 110 decreases, and the strength of the bond increases. These dimensions can be determined based upon the choice of materials and the function of the resulting bonded component.

Figure 2:
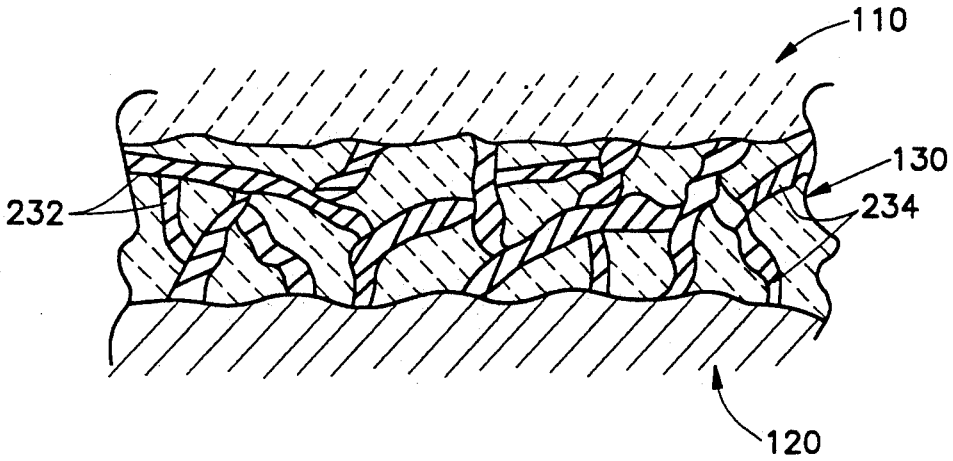

FIG. 2 shows an enlarged cross-section of the bond region 130 of the component shown in FIG. 1. This embodiment shows a plurality of interconnected channels 232 within the bond region 130. The interconnected channels 232 are filled with the same metal 234 that forms the metal part 120. In this manner, the metal part 120 is bonded to the ceramic part 110 without the need for additional materials or components.

A method of forming the bonded component shown in FIG. 1 will now be described. The first step is fabrication of a ceramic part which contains a plurality of interconnected channels or porous voids. This can be accomplished by two alternative methods. One method includes the addition of fibers to a ceramic powder to form a ceramic mixture. This ceramic mixture is then compacted by known means to form a ceramic shape. Known means are then used to fire or bake the ceramic shape in order to burn away, or pyrolyze, the fibers, leaving a plurality of interconnected channels or porous voids. Preferably, fibers such as carbon or nylon can be used with this method, with a temperature of about 600° C. for carbon and about 400° C. for nylon.

Alternatively, the ceramic part can be fabricated by chemically dissolving, decomposing, or leaching the fibers from the ceramic shape. Fibers are added to a ceramic powder to form a ceramic mixture which is then cast, such as by injection molding or slip-casting, into a ceramic shape. The fibers in the ceramic shape are then dissolved through the addition of appropriate chemical agents. Preferably, organic carbon-containing fibers such as nylon or polyester fibers can be used with this method.

After removal of the fibers from the ceramic shape, a ceramic part with a plurality of interconnected channels or porous voids results. The ceramic part is then heated and placed into a pressure casting or squeeze casting die. Molten metal, or a metal matrix alloy such as $Al/SiC_p$ or $Mg/SiC_p$, which will form the metal part of the bonded component and which will fill the interconnected channels or porous voids, is then pressurized and forced into the die. Simultaneously, the metal part is cast and the molten metal is forced into the interconnected channels or porous voids. The molten metal then solidifies in the channels or porous voids to form the bond or joint between the metal part and the ceramic part. Consequently, the metal part and the bond are formed concurrently. The bonded component is then ejected from the die.

The invention which is intended to be protected herein should not be construed as limited to the particular forms disclosed, as these are to be regarded as illustrative rather than restrictive. For example, the selection of material used for the ceramic, fiber, and metal can be varied depending upon the particular function for the bonded component. Other methods can be used to fabricate the ceramic part containing the plurality of interconnected channels of porous voids. Additionally, other methods can be used to concurrently form the metal part and force the metal into the interconnected channels or porous voids to form the bond.

Variations and changes may be made by those skilled in the art without departing from the spirit of the invention. Accordingly, the foregoing detailed description should be considered exemplary in nature and not limited to the scope and spirit of the invention as set forth in the following claims.

What is claimed is:

1. A method of forming a bonded component comprising the steps of:

selecting a ceramic powder;

mixing a plurality of fibers with a preselected portion of said powder and forming a mixture of fibers and ceramic powder;

compacting said ceramic powder and said mixture of fibers and ceramic powder and forming a ceramic part having a bond region consisting essentially of said mixture of said fibers and ceramic powder;

removing said fibers from said bond region and forming a plurality of interconnected voids in said bond region of the ceramic part;

subsequently heating said ceramic part;

placing said ceramic part into a pressure casting die;

pouring a molten metal into said die;

pressurizing said die to cast a metal part from said molten metal and simultaneously forcing said molten metal into said interconnected voids in said bond region of the ceramic part;

solidifying said molten metal in said interconnecting voids, thereby bonding said ceramic part and said metal part together to form a bonded component; and ejecting said bonded component from said die.

2. A method of forming a bonded component according to claim 1, wherein said step of removing said fibers from said bond region comprises firing said ceramic part such that said fibers are burned away.

3. A method of forming a bonded component according to claim 2, wherein said ceramic powder comprises alumina and said fibers comprise carbon.

4. A method of forming a bonded component according to claim 1, wherein said step of removing said fibers from said bond region comprises dissolving said fibers in said ceramic part.

5. A method of forming a bonded component according to claim 4, wherein said ceramic powder comprises alumina and said fibers comprise nylon.

6. A method of forming a bonded component according to claim 1, wherein said molten metal comprises an aluminum alloy.

7. A method of forming a bonded component according to claim 1, wherein said molten metal comprises an aluminum metal matrix composite alloy.

* * * * *